US006245955B1

(12) United States Patent
Smith

(10) Patent No.: US 6,245,955 B1
(45) Date of Patent: Jun. 12, 2001

(54) METHOD FOR THE SUB-SEA SEPARATION OF HYDROCARBON LIQUIDS FROM WATER AND GASES

(75) Inventor: David Randolph Smith, Bellville, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/386,748

(22) Filed: Aug. 31, 1999

Related U.S. Application Data

(60) Provisional application No. 60/098,745, filed on Sep. 1, 1998.

(51) Int. Cl.[7] ..... C07C 7/20
(52) U.S. Cl. ..... 585/15; 585/950
(58) Field of Search ..... 585/15, 950

(56) References Cited

U.S. PATENT DOCUMENTS 3,126,334 * 3/1964 Harlow ..... 585/15
3,856,492 * 12/1974 Klass ..... 585/15
5,055,178 * 10/1991 Sugier et al. ..... 585/15
5,536,893 * 7/1996 Gudmundsson ..... 585/15
5,950,732 * 9/1999 Agee et al. ..... 585/15
6,028,234 * 2/2000 Heinemann et al. ..... 585/15
6,082,118 * 7/2000 Endrizzi et al. ..... 585/15
6,111,155 * 8/2000 Williams et al. ..... 585/15

* cited by examiner

*Primary Examiner*—Jacqueline V. Howard
(74) *Attorney, Agent, or Firm*—Beverlee G. Steinberg

(57) ABSTRACT

There is provided a method to separate sub-sea and/or liquid hydrocarbons from the commingled stream of gas, water, oil, and or hydrocarbon condensate produced from subterranean wells comprising collecting a subterranean well product from at least one subterranean well, wherein said subterranean well product comprises hydrocarbon liquid, gas and water; forcing the water and gas to form hydrates; and separating the hydrates from the hydrocarbon liquid.

11 Claims, 2 Drawing Sheets

METHOD FOR THE SUB-SEA SEPARATION OF HYDROCARBON LIQUIDS FROM WATER AND GASES

This application claims the benefit of U.S. Provisional Application 60/098,745 filed Sep. 1, 1998.

FIELD OF THE INVENTION

The invention relates to the sub-sea or subterranean use of hydrate generations and separation in flow streams coming from a well in order to separate fresh water and or gas from salt water and or hydrocarbon fluid, in particular a sub-sea method and a sub-sea apparatus for the sub-sea separation of hydrocarbon liquids from gases and water.

BACKGROUND OF THE INVENTION

In the oil and gas industry, sub-sea wells produce from subterranean rock reservoirs a commingled stream consisting primarily of hydrocarbon liquids, water, and gases. This flowing stream is generally produced to the top of the sea or oceans surface at pressures and temperatures well above the surface atmospheric conditions. The well's flowing stream obtains the energy represented by these temperatures and pressures from the geothermal heat of the earth, the earth's overburden mass applied to the trapped subterranean gases and liquids, as well as the overburden weight of the ocean water. In offshore production industry it is found that portions of the energy available in this flowing stream are lost due to the cooling of the sea water and friction losses from transporting the flowing stream from the subterranean well at the sea floor to the process facility at the top of the sea surface. These energy losses are due in part to the fluid friction induced in flow lines, pipelines, as well as the loss of heat from the flowing stream due to cooling by the surrounding ocean water and currents as the well's flowing stream progresses to the sea surface process facility through pipelines.

It is a well known phenomena that gas hydrates often form in pipelines containing flowing streams produced from subterranean wells. Gas hydrate formation has long presented a problem to the industry, as it often results in the plugging of the flowing streams conduits to the sea surface process facility. Many methods and apparatus have been designed to reduce the potential for gas hydrate formation in offshore and sub-sea flow conduits. These methods include the heating of flow lines with electrical methods, vacuum insulated conduits, flow lines and wellheads, to keep the well stream from cooling, the addition of chemicals to inhibit hydrate formation, and many combinations thereof.

The conventional separation of liquids from gases flowing from subterranean wells is achieved by reducing the pressure of the commingled flowing stream and allowing the liquids and gases to separate by density differences in process facilities at the surface of the sea. In some cases the density separator is proceeded by cyclonic devices to reduce the water and or gas volume prior to the stream entering the larger separator vessel. In the case of offshore oil and gas production the fluid and gas production from the subterranean well is produced to the surface of the ocean and separated through conventional separation equipment on a surface offshore platform, or process equipment on a floating process vessel. Once these process facilities sufficiently separate the gas, and water from the oil in these surface process facilities, the liquid hydrocarbon is transferred to storage tanks, and transduced to market via an oil pipeline or a ship. Of the three separated items, liquid hydrocarbons, gas, and water, only the liquid hydrocarbon historically has been amenable to rapid commercialization due to its smaller volume at ambient pressures. The water produced from hydrocarbon reservoirs typically has little commercial value as it is usually salty and contains various impurities not suitable for commercialization. The separated gas produced from said subterranean wells require much more processing or infrastructure to transduce to a market. Therefore, whilst the gas has commercial value it is often to far from the market, or will require further processing to make it transportable, and or will require significant cost to transport due to it's volume at ambient sea surface conditions. Conversely, when gas is exploited form said subterranean reservoirs the associate salt water produced is dumped into the sea, or in rare cases re-injected into subterranean reservoirs.

Currently, when hydrocarbons are discovered with sufficient or economic amounts of liquids, the oil or condensate is commercialized and the gas is flared to the atmosphere or re-injected to the subterranean reservoir to maintain the reservoirs energy to produce hydrocarbons and enhance the recovery of the liquid hydrocarbon from the reservoir. The associated salty water is again dumped in the sea or ocean and or reinjected below the sub-sea surface. When the gas produced from a subterranean well is in an area of the world close to market it is commercialized. More recently the capricious venting of the gas to the atmosphere is being reduced for safety and environmental reasons. Therefore, if a hydrocarbon reservoir is discovered where the flowing stream produced from the subterranean reservoir contains gas, and there is no close point of commercialization, the alternatives for the gas are; to vent it to the atmosphere, burn it at surface, build a cryogenic gas plant, known as a liquid natural gas plant, LNG, for liquid storage and transport or re-inject it into the reservoir.

The gas separated from the flowing stream is often burned to generate power for the facilities electrical and heating needs, or re-injected into the subterranean reservoirs through a system of compressors, and conduits proceeding from the platform to the sub-sea well, or be compressed and transduced into gas pipelines. Conversely, the gas can be flared to the atmosphere. The injection of gas into the reservoir is difficult in many offshore areas owing to the very large pressures that the gas must be compressed to. This gas injection pressure required is a function of the distance the sub-sea well is from the sea surface process facility and compression station, as well as a function of the subterranean well depth in the sea and depth in the earth's surface. That is, the increased energy required to move the gas large distances in gas pipeline increase the energy required to compress the gas, and the pressure the gas must be compressed to must be more than the subterranean reservoir pressure that it is to be injected to. The subterranean reservoir pressure is typically a function of the depth below the sea. Hence the gas injection pressures to the reservoir increase as the distance from the surface process facility increases.

Likewise, the water produced from the subterranean well and separated by the surface process facility can be injected into the subterranean reservoir by a system of pumps and conduits proceeding from the surface facility down to the well and into the reservoir. Conversely the water can be dumped into the sea at surface. In either case, the separated water and gas must be either dumped to the atmosphere or reinjected if a commercialization point is not available. Unlike oil, gas can not be stored in a low-pressure vessel of a relatively small size, nor can gas be transported to market by a conventional ship. And unlike oil or gas salty water even when near populated areas has no commercial value.

U.S. Pat. No. 5,536,893 discloses a method to transport or store gas by conversion of a gas to a gas hydrate. In the U.S. Pat. No. 5,536,893 case the gas is pressurized after being purified and separated from the water and oil produced from the subterranean wells. Hence U.S. Pat. No. 5,536,893 discloses a method to create hydrates from an already processed gas. It does not teach the art of using the energy available from the wells at the sub-sea node to operate or power process equipment, nor does it teach the generation of hydrates below the sea level.

In some conditions, for example 3000-ft of water depth or more offshore, the well fluids and gases produced from subterranean depth reach the seafloor at pressures and temperatures higher than the surrounding sea floor environment. This condition clearly represents available energy to perform work, and can be exploited by those familiar with thermodynamic methods, for example Stirling cycle engines and refrigeration devices can easily be operated on these temperature differentials, to power and drive processes at the seafloor. The colder ambient temperatures of the seawater enhance the creation of gas hydrates in the flow stream in well heads, sub-sea flow lines and pipelines. These gas hydrates are a combination of water and gas forming a crystalline structure that encapsulates gas inside of the crystalline structure of hydrogen bonded molecules. The overall appearance is much like ice. The gas hydrate is often referred to in the literature as a clathrate hydrate of natural gas. The uncontrolled formation of hydrates in hydrocarbon processes results in the precipitation of the hydrates in flow steam of wells and sub-sea pipelines, and the literature teaches many methods and art in reducing the formation of hydrates in the oil and gas production industry. This precipitation becomes a significant impediment to the flow of the produced fluids and gases, and can completely stop the flow from the well at subterranean depths, in pipeline, process equipment, or other production equipment. Another interesting phenomena of the gas clathrate formation is that it separates the salt from the produced water such that the resulting crystal structure is a fresh water lattice encapsulating the gas. Hence the phenomena naturally separates from salt water the fresh water in a solid structure.

One method used to reduce the impediment to flow that the hydrate precipitation can produce is to inject into the stream chemicals that inhibit the hydrate formation in the sub-sea wells, wellheads, manifolds, and pipelines. This inhibition has been done with methanol, glycol, and other chemicals.

It has also been shown that insulating the flow lines and pipelines of flowing fluid streams in the sub-sea environment can reduce the hydrate formation in the flow stream. This has been done using different types of insulation techniques like vacuum-jacketed pipelines, coated pipelines and insulated jackets, etc. Other methods of reducing the affect of the cold ambient conditions sub-sea on the flowing stream have been used such as heating the pipeline with chemical or electrical heating methods.

Conventionally in the oil and gas industry, the pressure in the production fluids and gases is dissipated during the separation, storage, and transport phase. This is done as the higher pressures presents safety problems for storage vessels and transport lines as well as requiring expensive high-pressure storage and transport equipment. This problem of handling high-pressure gases in conventional oil and gas process equipment is further complicated by chemical corrosion in storage and transport equipment. That is, the combination of gases and water in the flowing stream can cause corrosion of process equipment, pipelines, and storage vessels. Also the combination of gasses, and water can cause the precipitation of scales that can cause plugging of equipment.

SUMMARY OF THE INVENTION

It is an objective of the present invention to provide a method to separate sub-sea and/or liquid hydrocarbons from the commingled stream of gas, water, oil, and or hydrocarbon condensate produced from subterranean wells. There is provided a process to separate liquid hydrocarbons from gas and or water produced from subterranean wells, said process comprising:

collecting a subterranean well product from at least one subterranean well, wherein said subterranean well product comprises hydrocarbon liquid, gas and water;

forcing the water and gas to form hydrates; and separating the hydrates from the hydrocarbon liquid. solid gas hydrates.

In another embodiment of the invention, there is provided a process to separate liquid hydrocarbons from gas and or water produced from subterranean wells, said process comprising:

collecting a subterranean well product from at least one subterranean well, wherein said subterranean well product comprises hydrocarbon liquid, hydrocarbon gas and salt water;

mixing said salt water with said hydrocarbon gas to form gas clathrates;

separating the gas clathrates from the hydrocarbon liquid;

melting said gas clathrates to liquid; and collecting said liquid.

DETAILED DESCRIPTION

Figure 1:
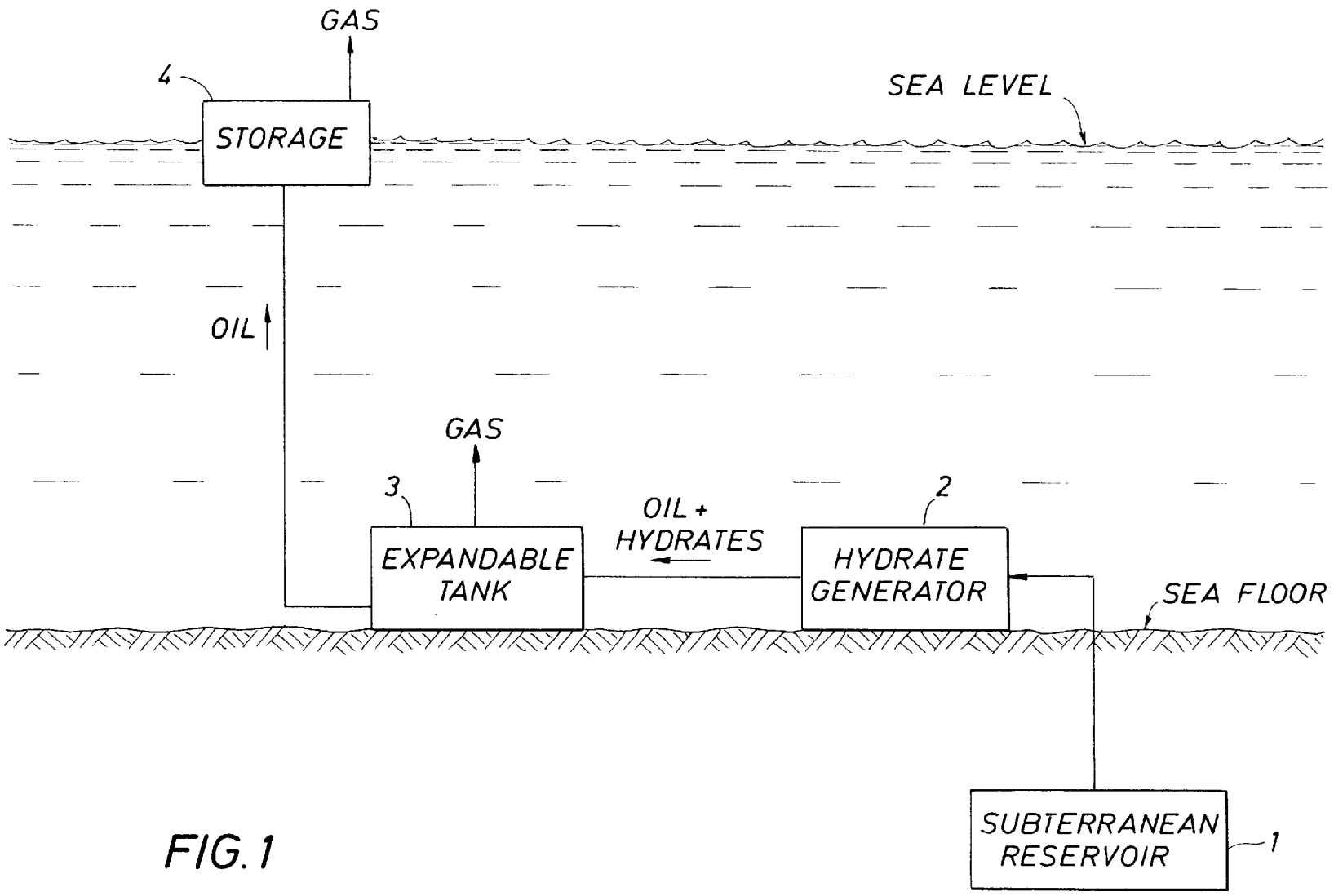
FIG. 1 is a schematic of the process and apparatus from sub-sea floor to ocean surface.

The process of the invention takes a commingled production stream of oil, gas, and water from subterranean wells and depressurizes and cools the commingled stream. The stream is depressurized and cooled in the wellbore and or at the sea floor, enhancing the formation and precipitation of hydrates from the liquids. Hydrate precipitation may be further enhanced by cooling the flowing stream, using heat exchanger methods, throttle valves, turbo-expanders, thermodynamic cooling machines, and other cooling methods. Sub-sea additional water, solids, chemicals, and gases may also be added to the commingled production steam from the well to enhance hydrate generation. The solid hydrate crystals are then separated from the liquids with any of the well known liquid solid separations techniques, including but not limited to gravity settling, centrifuges, hydrocyclones, etc.

The hydrocarbon steam is circulated through the process until the degree of separation of gas and water from the hydrocarbon stream is sufficient by continued cooling of the liquid flow stream using any of the well-known cooling methods and devices, including but not limited to throttle valves, porous media, heat exchangers, refrigeration machines, and turbo-expanders further separates any gas remaining in the liquid flow stream. The liquid is separated from the gases using the hydrate precipitation separation process until the liquid stream is sufficiently free of gas to be transduced in sub-sea pipelines, be stored in sub-sea tanks, or to be transduced to a surface vessel or ship.

According to the present invention, a subterranean well's production stream, consisting of water, gases, liquid hydrocarbons, and any combination thereof, is separated sub-sea into water, liquid hydrocarbons, and gas hydrates. A flowing stream from subterranean wells may be processed in a sub-sea environment. The method forces the production of gas hydrates in the production stream, and subsequently separates the solid hydrates form the stream.

The flowing stream from the wells is then depressurized and cooled through a series of processes and devices. It is readily obvious to those familiar with the art of oil and gas production that the exact devices required in the process will vary depending on the actual conditions of the oil and gas reservoir, depth, water temperatures, fluid and gas characteristics, etc.

The process of the invention separates liquid hydrocarbons from gas and or water produced from subterranean wells by first collecting a subterranean well product from at least one subterranean well. The well product collected typically comprises hydrocarbon liquid, gas and water, in various combinations. The water and gas are forced, using a controlled process, to form hydrates and the hydrates are then separated from the hydrocarbon liquid.

The hydrate formation takes place at or near the sea floor or inside the subterranean well. Hydrate formation at the sea floor may be done by several means. It is preferred to first depressurize the subterranean well product in a controlled process to separate the hydrocarbon liquid from the gas and water. This depressurization process in itself can force the water and gas to form hydrates. When hydrate formation is performed inside the subterranean well, several means may be used to force, or seed the hydrate formation. This subterranean hydrate generation can be achieved and controlled by any combination of seeding the flowing stream with solid materials, addition of gases to the stream, or the use of chemicals to the stream.

Separation of the hydrates from the hydrocarbon liquid takes place at or near the sea floor. The hydrates may be separated from the hydrocarbon liquid by using any of the well known methods of separation of solids and liquids. These include, but not limited to, passing the hydrates and hydrocarbon liquid through a hydrocyclone, allowing the hydrates to settle out from the hydrocarbon liquid, placing the hydrates and hydrocarbon liquid in a stirring tank, placing the hydrates and hydrocarbon liquid in a centrifuge, and combinations thereof.

When hydrate formation takes place below the surface of the earth, for example in the subterranean well, hydrates and hydrocarbon liquid may be further passed through a sub-sea process facility. In such a facility, any remaining water and gas may be forced to format more hydrates. All the hydrates may be separated from the liquid stream through the various well know methods of solid liquid separation already discussed.

The clarified and separated hydrocarbon liquid, e.g., oil, can then be transported to a suitable sub-sea tank farm, shipping tanker or a pipeline.

It is well recognized by those familiar with the art of hydrate generation that maintaining the process at low temperatures is useful in generating stable hydrates, as well as handling hydrates in the separation and any associated process. To this end regenerative thermal machines may be used for powering the process as well as maintaining or refrigerating the generated hydrate slurry and solids at a stable temperature.

The colder ambient temperatures of the seawater enhance the creation of gas hydrates in the flow stream in well heads, sub-sea flow lines and pipelines. These gas hydrates are a combination of water and gas forming a crystalline structure that encapsulates gas inside of the crystalline structure of hydrogen bonded molecules. The overall appearance is much like ice. The gas hydrate is often referred to in the literature as a clathrate hydrate of natural gas. An interesting phenomena of gas clathrate formation is that it separates the salt from the produced water such that the resulting crystal structure is a fresh water lattice encapsulating the gas. Hence the phenomena naturally separates from salt water the fresh water in a solid structure. In a second embodiment of the invention fresh water is separated from subterranean produced salt water or sea water by forcing gas from subterranean sources to form clathrates with the salt waters. Produced salt water or sea water, is mixed with the produced hydrocarbon gas to form gas clathrates. The gas clathrates are separated from the hydrocarbon liquid and then melted to liquid form to exploit the freshwater that is separated in the process of clathrates formation.

A process whereby gas hydrates are formed sub-sea is further described by reference to the figures. In FIG. 1 the flowing stream is transduced from the subterranean reservoir and well bore 1 to the hydrate generator 2, and then transduced to an expandable tank 3, for example a bladder or an inflatable tank, resting on or near the seafloor. The oil, gases and hydrates are allowed to separate in the tank 3, for example by settling. Oil is removed from the tank 3 and transduced to surface storage 4, such as a production floating buoy where it can be transferred to a ship or tanker. Gases may be transduced to the surface, or allowed to vent at tank 3 and or storage 4. To enhance hydrate formation, a hydrate seed pump and an in-situ hydrate generator may be placed in the well bore 1.

The process depressurizes and hence cools the stream in the well bore 1, and or at the seafloor in the sub-sea hydrate generator 2, enhancing the formation and precipitation of hydrates from the liquids. The process enhances hydrate precipitation by cooling the flowing stream from the well using heat exchanger methods, throttle valves, turbo-expanders, thermodynamic cooling machines, and other cooling methods. The hydrate generator 2 may contain a plurality of devices to achieve the formation of hydrate sub-sea, depending on the requirements of the process and the conditions of the reservoir and sub-sea environment.

Figure 2:
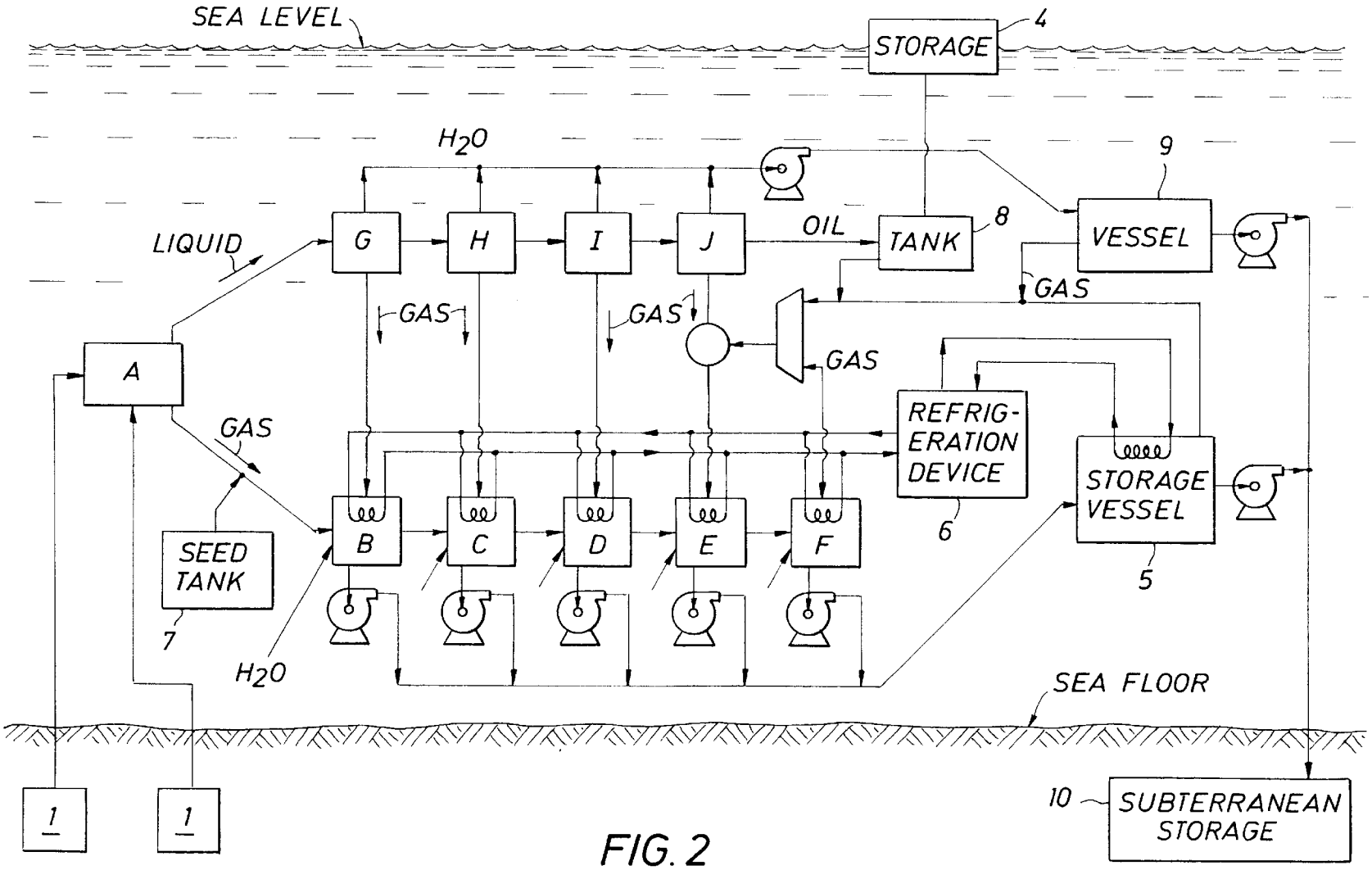
FIG. 2 shows a process for dividing the flow stream at the sea floor.

In FIG. 2, the flowing stream is transduced from the subterranean reservoir and well bore 1 to node A, where it is divided into several different flow trains. The liquid and gases are partially separated at node A using expansion into a cyclone separator, or by using centrifugal force, or by the use of other methods and devices known to those familiar with the art of liquid and gas separation. The gas stream then proceeds in the process to node B, whilst the separated liquid proceeds to node H. At node B the flow stream is expanded through any combination of familiar devices such as throttle valves, turbo-expanders, or nozzles into a cold liquid filled chamber, whilst adding water and or seeding solids and chemicals to the expanding gas stream. The expanded stream of water and solid hydrate crystals are then separated from the cold fluid using classifiers, cyclone separators, density or any combination of known solid liquid separators. These separated solid hydrate crystals are transduced to hydrate storage 5. The remaining gas is then repeatedly passed though one or more additional expansion separation nodes C, D, E, F, or circulated, compressed, and cooled into nodes, B, C, D, and E as required to encapsulate the gas in hydrate crystals. These gas expansion/separation nodes are all cooled by the external seawater, cold fluids in the nodes, which the gas is expanded into, and or a combination of additional cooling coils inside the node with refrigerant circulated through them. A refrigeration device 6 may be used to cool a refrigerant fluid used in the process to cool the nodes in the gas train. The refrigeration fluid is transduced to each node, and circulated through cooling coils, as required to extract heat from the node and maintain the internal temperature of the node to facilitate gas hydrate formation and stabilization. The refrigerant is circulated out of the node and thus transfers the heat to the ocean waters or to the liquid train for heating. The process also makes use of the novel method of sub-sea seeding the flowing stream with hydrate enhancement particles and gases. A seed tank 7 may be added upstream of the gas train. Seed is withdrawn or injected into the flowing stream prior to it entering node B for hydrate formation. Likewise, the seeding material can be added prior to expansion into any of the other nodes in the gas train.

The liquids from node A are passed to the liquid train node G and proceeding progressively to additional nodes H, I and J as required. At node G the liquid flow stream is separated from any remaining gas by heating the stream, expanding it to a lower pressure and separating the oil and gas through separation devices. The remaining liquid stream is transduced to liquid classifiers in node G where oil and water are further separated. This is repeated through nodes H, I and J until the required amount of water is separated from the oil and the pressure is reduced to allow for safe liquid storage at tank 8. Any process gas proceeding from tank 8 during storage is circulated back to the gas train for further processing. The separated gas from the liquid train, nodes G, H, I and J, is transduced to the gas train, nodes B, C, D, E and F to be processed into a gas hydrate and stored in a cold gas hydrate tank 5. Any gas that remains or is generated at tank 5 is circulated to the gas train for processing into gas hydrates. Refrigerated fluids circulated from refrigerant device 6 cool tank 5.

Tank 9 is a storage vessel for water. It is possible to release the contents of vessels 5 (hydrate storage) and 9 (water storage) to the sea environment or, as proposed in the embodiment in FIG. 2, the contents of vessels 5 and 9 are injected into the subterranean reservoir 10. The water and hydrates initially form a slurry containing gas hydrates and liquid water, as well as other chemicals for flow, solid suspension, and ice inhibition, and can be pressurized in a pump and injected into subterranean reservoirs. Once the slurry proceeds below surface the gas hydrate will melt and expand due to geothermal temperatures in the reservoir. This addition of water and gas to the reservoir will assist in maintaining the reservoirs pressure and allow for more hydrocarbons to be ultimately removed from the reservoir.

The embodiment of FIG. 2 shows the oil being stored sub-sea in tank 8 and transferred to surface at storage tank 4. The sub-sea-stored oil can then be transferred to surface to a ship or tanker.

The invention describes methods of expanding the flow stream of a well, adding sub-sea additional water, solids, chemicals, and gases to the production steam from the well to enhance gas hydrate generation. The solid gas hydrate crystals so produced are then separated from the liquids with any of the well known liquid solid separations techniques, including but not limited to gravity settling, centrifuges, hydrocyclones, or any combination thereof. The gas stream is processed until the required amount of gas is encapsulated in the hydrate crystals by continued expansion, addition of water, seeding, and cooling of the flow stream using any of the well-known cooling methods and devices, including but not limited to throttle valves, porous media, refrigeration machines, and turbo-expanders. The liquid is separated from the gasses using the hydrate precipitation separation process until the liquid stream is sufficiently free of gas to be transduced in sub-sea pipelines, be stored in sub-sea tanks or bladders, or to be tansduced to a surface vessel or ship. It is clear to those familiar with the art of fluid and gas processes that the above mentioned apparatus and methods can be modified to use gas from subterranean wells to from either gas wells or gas from oil wells to form clathrates either at sub-sea or at surface and commercialize the freshwater available from the melted hydrates as well as the gas contained in the hydrate.

What is claimed is:

1. A process to separate liquid hydrocarbons from gas and or water produced from subterranean wells, said process comprising:

collecting a subterranean well product from at least one subterranean well, wherein said subterranean well product comprises hydrocarbon liquid, gas and water;

depressurizing the subterranean well product to separate said hydrocarbon liquid from said gas and water;

forcing the water and gas to form hydrates; and separating the hydrates from the hydrocarbon liquid;

wherein said depressurization, said forcing and said separation are performed at or near the sea floor.

2. The process of claim 1 wherein said hydrates are separated from said hydrocarbon liquid by a means selected from passing the hydrates and hydrocarbon liquid through a hydrocyclone, allowing the hydrates to settle out from the hydrocarbon liquid, placing the hydrates and hydrocarbon liquid in a stirring tank, placing the hydrates and hydrocarbon liquid in a centrifuge, and combinations thereof.

3. The process of claim 1 wherein said forcing is performed inside the subterranean well.

4. The process of claim 3 wherein said hydrates are generated by a means selected from seeding said well product with solid materials, adding gas to said well product, adding chemicals to said well product, or combinations thereof.

5. The process of claim 3 further comprising passing said hydrates and said liquid hydrocarbon through a sub-sea process facility; and forcing remaining water and gas to form hydrates.

6. The process of claim 5 wherein said steps take place before separation.

7. The process of claim 1 wherein said gas is separated from said hydrocarbon liquid and said water by forcing the gas to be encapsulated in a hydrate crystal.

8. The process of claim 1 further comprising injecting a slurry consisting of said hydrates and a liquid into a subterranean hydrocarbon reservoir, thereby improving the recovery of the hydrocarbons in the reservoir.

9. The process of claim 1 wherein said well product comprises hydrocarbon gas and/or liquids and said hydrates are formed by adding water to said hydrocarbon gas and/or liquids and expanding the mixture to form gas hydrates.

10. The process of claim 1 wherein said hydrates are formed by expanding said gas into a chamber of cold liquid at a lower pressure to form gas hydrates in the cold liquid.

11. A process to separate liquid hydrocarbons from gas and or water produced from subterranean wells, said process comprising:

collecting a subterranean well product from at least one subterranean well, wherein said subterranean well product comprises hydrocarbon liquid, hydrocarbon gas and salt water;

mixing said salt water with said hydrocarbon gas to form gas clathrates;

separating the gas clathrates from the hydrocarbon liquid;

melting said gas clathrates to liquid; and collecting said liquid.

* * * * *